US005727990A

United States Patent [19]

Hasegawa et al.

[11] Patent Number: 5,727,990

[45] Date of Patent: Mar. 17, 1998

[54] METHOD FOR MIRROR-POLISHING CHAMFERED PORTION OF WAFER AND MIRROR-POLISHING APPARATUS

[75] Inventors: Fumihiko Hasegawa; Tatsuo Ohtani; Yasuyoshi Kuroda, all of Nishi-shirakawa-gun; Koichiro Ichikawa; Yasuo Inada, both of Nagano, all of Japan

[73] Assignees: Shin-Etsu Handotai Co., Ltd., Tokyo; Fujikoshi Machinery Corp., Nagano, both of Japan

[21] Appl. No.: 779,040

[22] Filed: Jan. 6, 1997

Related U.S. Application Data

[63] Continuation of Ser. No. 457,473, Jun. 1, 1995, abandoned.

[30] Foreign Application Priority Data

Jun. 17, 1994 [JP] Japan ..... 6-159542

[51] Int. Cl.[6] ..... B24B 1/00; B24B 7/24; B24B 9/14

[52] U.S. Cl. ..... 451/44; 451/57; 451/65; 451/221; 451/254

[58] Field of Search ..... 451/43, 44, 289, 451/178, 388, 57, 65, 212, 214, 285, 221, 256, 390

[56] References Cited

U.S. PATENT DOCUMENTS

| | | | |
|---|---|---|---|
| 4,286,415 | 9/1981 | Loreto | 451/44 |
| 4,344,260 | 8/1982 | Ogiwara | 451/44 |
| 4,793,101 | 12/1988 | Dlouhy et al. | 451/44 |
| 5,295,331 | 3/1994 | Honda et al. | 451/44 |

FOREIGN PATENT DOCUMENTS

| | | | |
|---|---|---|---|
| 0393951 | 10/1990 | European Pat. Off. . | |
| 0515036 | 11/1992 | European Pat. Off. . | |
| 0601748 | 6/1994 | European Pat. Off. . | |
| 56-13728 | 2/1981 | Japan . | |
| 58-160050 | 9/1983 | Japan . | |
| 63-16959 | 1/1988 | Japan . | |
| 1020958 | 1/1989 | Japan | 451/44 |

OTHER PUBLICATIONS

Patent Abstracts of Japan, vol. 12, No. 218 (M-711) [3065], Jun. 22, 1988.

*Primary Examiner*—Timothy V. Eley
*Attorney, Agent, or Firm*—Oliff & Berridge, PLC

[57] ABSTRACT

A method and an apparatus, which enable mirror-polishing a peripheral chamfered portion of a semiconductor wafer effectively, are disclosed. Mirror-polishing a peripheral side surface of the chamfered portion of the wafer, beveled surfaces thereof, and rounded edges formed between the peripheral side surface and each of the beveled surfaces, are individually carried out.

8 Claims, 3 Drawing Sheets

METHOD FOR MIRROR-POLISHING CHAMFERED PORTION OF WAFER AND MIRROR-POLISHING APPARATUS

This is a Continuation of application Ser. No. 08/457,473 filed Jun. 1, 1995 now abandoned.

BACKGROUND OF THE INVENTION

1. Field of the Invention

The present invention relates to a method for mirror-polishing a peripheral chamfered portion of a semiconductor wafer and to an apparatus for mirror-polishing useful for carrying out the method. The semiconductor wafer to which the present invention may be applied, as shown in FIG. 1, comprises a peripheral chamfered portion 1 comprising a peripheral side surface 1*a*, front and back beveled surfaces 1*b* and 1*c* formed on front and back surfaces, respectively, along the periphery of the wafer W, and rounded edges 1*d* and 1*e* formed between the peripheral side surface 1*a* and each of the front and back beveled surfaces 1*b* and 1*c*.

2. Description of Related Art

Conventionally, as shown in FIG. 5, in order to mirror-polish such a peripheral chamfered portion 1 of a semiconductor wafer W, a mirror-polishing device 31 having a polishing portion 31*a* with the so-called a form chamfering buff which has a circumferential buff groove on a peripheral surface thereof, with a section corresponding to that of the chamfered portion 1 of the wafer W, has been used. If there were no variation in shape of the chamfered portion, and the section of the chamfered portion completely corresponded to the section of the buff groove, such a mirror-polishing apparatus 31 with a form chamfering buff has an advantage of mirror-polishing the chamfered portion 1 of the wafer w effectively because the entirety of the chamfered portion 1 is in contact with the inner surface including the bottom surface of the groove of the buff member 31*a* simultaneously, so that mirror-polishing for the entirety of the chamfered portion 1 is performed at a time.

However, in practice, there are variations not only in thickness of wafer W but in shape of the peripheral chamfered portion 1 which are created in a wafer chamfering step, a lapping step, an etching step or the like. Therefore, during mirror-polishing step of the chamfered portion 1, it often happens that all of a peripheral side surface 1*a*, beveled surfaces 1*b* and 1*c* and rounded edges 1*d* and 1*e* are not in contact with the inner surface of the polishing portion 31*a* in the groove at a time. When the thickness of a wafer W is larger than a desired one, at first mirror-polishing about the beveled surfaces 1*b* and 1*c* of the chamfered portion 1 of the wafer W is carried out by the inner surface of the buff groove. After the portion of the beveled surfaces 1*b* and 1*c* have been worn out to a certain extent by the mirror-polishing, the rounded edges 1*d* and 1*e* of the chamfered portion 1 of the wafer W come into contact with the inner surface of the buff groove. Then, after the portions of the beveled surface 1*b* and 1*c* have been worn out to a further extent by the mirror-polishing, the peripheral side surface 1*a* comes into contact with the bottom surface of the buff groove. On the contrary, when the thickness of a wafer W is smaller than a desired one, at first mirror-polishing about the peripheral side surface 1*a* is carried out by the bottom surface of the buff groove, however, the beveled surfaces 1*b* and 1*c* and the rounded edges 1*d* and 1*e* of the chamfered portion are scarcely mirror-polished by the inner surface of the buff groove, until the portion of the peripheral side surface 1*a* is worn to a certain extent. Therefore, there is a problem that when there is variations in thickness of the wafer W or in shape of the peripheral chamfered portion 1 thereof, mirror-polishing for the peripheral chamfered portion of the wafer W requires considerable time.

SUMMARY OF THE INVENTION

The present invention was developed in view of the above-described conventional problems. An object of the present invention is to provide a method which enables mirror-polishing a peripheral chamfered portion of a semiconductor wafer effectively and an apparatus for mirror-polishing useful for carrying out the method.

In accordance with one aspect of the present invention, the method for mirror-polishing a peripheral chamfered portion of a semiconductor wafer which comprises a peripheral side surface, beveled surfaces formed on front and back surfaces along the periphery of the wafer, and rounded edges formed between the peripheral side surface and each of the beveled surfaces, comprises; a step of rotating the wafer around the central axis thereof, and steps of mirror-polishing the peripheral side surface, the beveled surfaces, and the rounded edges by a polishing device, wherein at least one of these mirror-polishing steps is performed independent of one another.

Preferably, each mirror-polishing of the peripheral side surface, the beveled surfaces, and the rounded edges, is individually performed.

According to the above described means, because the peripheral side surface, the beveled surfaces and the rounded edges, of the peripheral chamfered portion of the wafer, are individually mirror-polished, each of the peripheral side surface, the beveled surfaces and the rounded edges can be securely pressed against respective polishing portions from the beginning, in an appropriate order. Consequently, the peripheral side surface, the beveled surfaces and the rounded edges, of the peripheral chamfered portion of the wafer, can be securely and effectively polished even if there were variations in thickness of wafer, or in shape of the peripheral chamfered portion which were created in a wafer chamfering step, a lapping step, an etching step or the like.

The mirror-polishings of the peripheral side surface, the beveled surfaces, and the rounded edges of the peripheral chamfered portion, may be performed by bringing the peripheral side surface, the beveled surfaces, and the rounded edges into contact with first, second, and third polishing portions, which are provided on the polishing device independent of one another, respectively, in an appropriate order. The first polishing portion may comprise a first buff which can be in contact with the peripheral side surface of the peripheral chamfered portion, the second polishing portion may comprise a second buff Which can be in contact with the beveled surfaces, and the third polishing portion may comprise a third buff which can be in contact with the rounded edges.

In accordance with another aspect of the present invention, the apparatus for mirror-polishing a peripheral chamfered portion of a semiconductor wafer which comprises a peripheral side surface, beveled surfaces formed on front and back surfaces along the periphery of the wafer, and rounded edges formed between the peripheral side surface and each of the beveled surfaces, comprises a cylindrical rotary polishing device which comprises; a first polishing portion having a first buff which can be in contact with the peripheral side surface, a second polishing portion having a second buff which can be in contact with the beveled surfaces, and a third polishing portion having a third buff which can be in contact with the rounded edges formed between the peripheral side surface and each of the beveled surfaces, wherein the first, second, and third polishing portions are provided on the peripheral surface of the apparatus independent of one another.

Preferably, the first buff of the first polishing portion can mirror-polish about the peripheral side surface of the peripheral chamfered portion of the wafer, the second buff of the second polishing portion can mirror-polish about each of the beveled surfaces, and the third buff of the third polishing portion can mirror-polish about each of the rounded edges. The apparatus may further comprise a wafer holding device for holding the wafer, which can rotate around the center thereof and can horizontally and vertically move relatively to the polishing device.

According to the apparatus, it is possible to securely and effectively polish the peripheral side surface, the beveled surfaces and the rounded edges even if there were variations in thickness of wafer, or in shape of the peripheral chamfered portion which were created in a wafer chamfering step, a lapping step, an etching step or the like.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Next, embodiments of the method and the apparatus, for mirror-polishing the peripheral chamfered portion of a semiconductor wafer according to the present invention will be explained with reference to the drawings.

Figure 1:
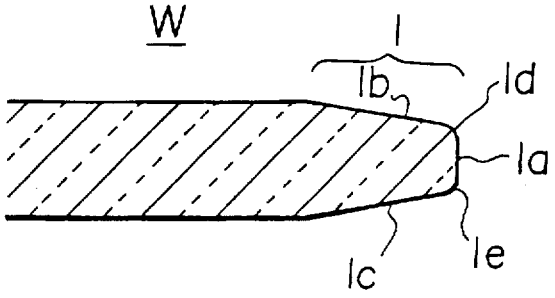
FIG. 1 is a view showing a shape of the peripheral chamfered portion of a wafer.

In the semiconductor wafer W which is the object to be mirror-polished by applying the present invention, as shown in FIG. 1, the beveled angle of each of the front and back beveled surfaces 1*b* and 1*c*, i.e., the angle between each plane of the beveled surfaces 1*b* and 1*c* and the plane of the front or back surface, is determined to a value which can prevent the periphery of the wafer W from being chipped off when the wafer is housed in a cassette in a handling step or when the periphery of the wafer hits to a positioning member in a wafer-positioning step. Further, a wafer W for fabricating semiconductor integrated circuits requires values of the beveled angles for the beveled surface 1*b* and 1*c* which can suppress occurrence of crown in the vicinity of the boundary between the main surface of the wafer W and the beveled surfaces 1*b* and 1*c* when a semiconductor single crystal layer is deposited thereon by a chemical vapor deposition method. The rounded edges 1*d* and 1*e* can prevent the boundary between the peripheral side surface 1*a* and the beveled surfaces 1*b* and 1*c* of the wafer W from being chipped-off or cracked.

Next, an embodiment of an apparatus for mirror-polishing the peripheral chamfered portion of a semiconductor wafer according to the present invention will be explained.

Figure 2:
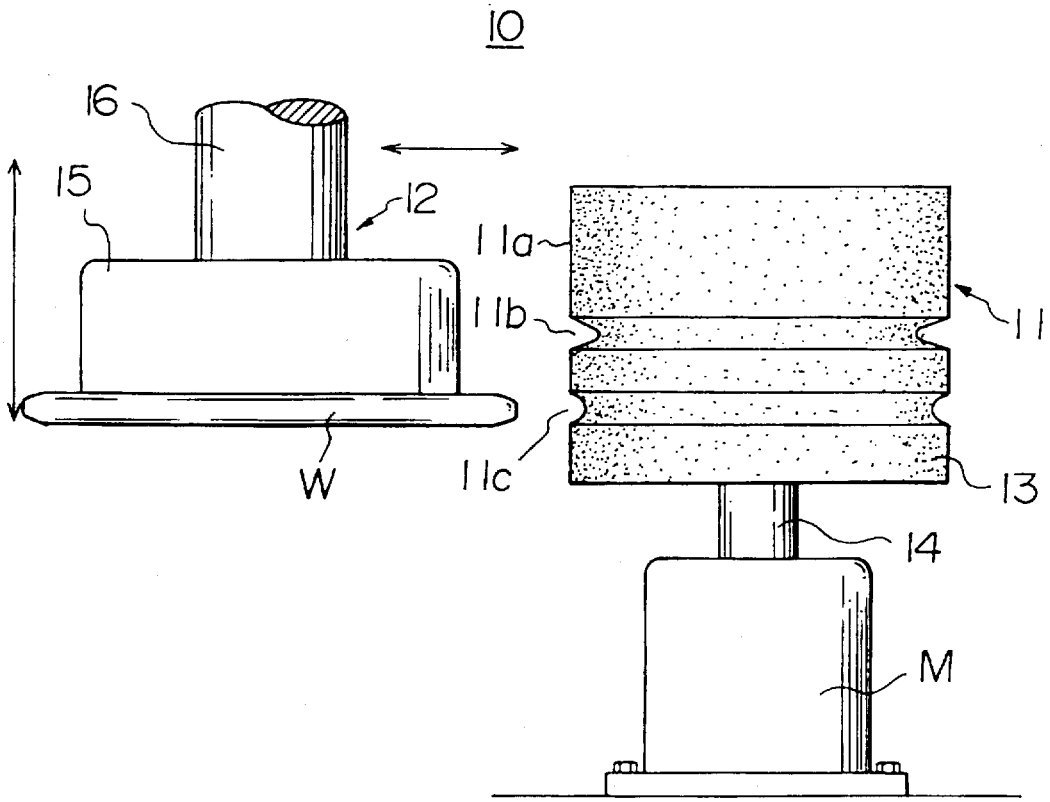
FIG. 2 is a view of the apparatus for mirror-polishing according to an embodiment of the present invention.

FIG. 2 shows the apparatus 10 for mirror-polishing. The apparatus 10 comprises a cylindrical rotary polishing device 11 for mirror-polishing the peripheral chamfered portion 1 of the wafer W, and a wafer holding device 12 for holding to carry the wafer W to desired positions.

Figure 3:
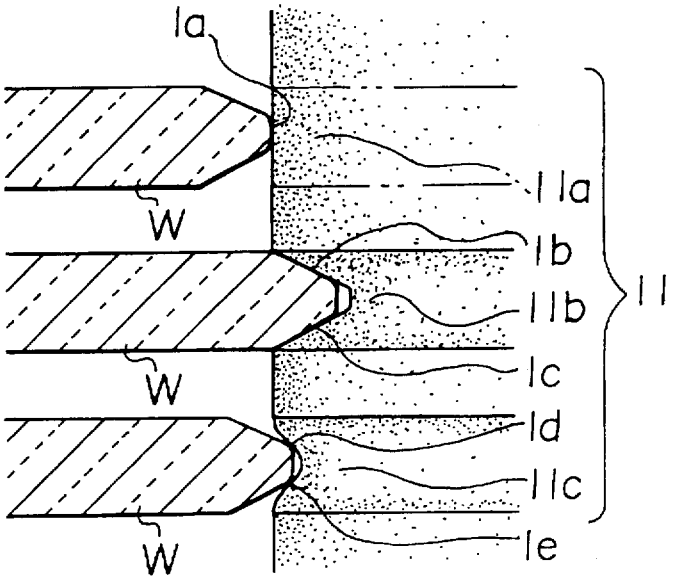
FIG. 3 is a view for explaining the method according to an embodiment of the present invention.

The polishing device 11 comprises a cylindrical polishing member 13 and a motor M for rotating the polishing member 13 through a rotary shaft 14. The polishing member 13 comprises a first polishing portion 11*a*, a second polishing portion 11*b*, and a third polishing portion 11*c*, which are provided independent of one another, on the peripheral surfaces of which a first buff, a second buff, and a third buff are respectively adhered, as shown in FIGS. 2 and 3. The first polishing portion 11*a* is for polishing the peripheral side surface 1*a* of the chamfered portion 1 of the wafer W, and therefore, it has no grooves on the surface. The first polishing portion 11*a* polishes the peripheral side surface 1*a* of the wafer W by the flexibility of the first buff. On the periphery of the second polishing portion 11*b*, a peripheral groove is formed and the second buff is adhered on the inner surface in the groove, for polishing the beveled surfaces 1*b* and 1*c* of the chamfered portion 1 of the wafer W. The second buff in the groove has a depth larger than the ideal length of the chamfered portion 1 in a radial direction, in due consideration of variations of the radial length of the chamfered portion 1. The depth and the shape of the groove of the second buff are determined so that the second buff in the groove can mirror-polish about the beveled surfaces 1*b* and 1*c*, that is, so that the peak of contact pressure distribution between the second buff of the second polishing portion 11*b* and the chamfered portion 1 is on each of the beveled surface 1*b* and 1*c*. On the periphery of the third polishing portion 11*c*, a peripheral groove is formed and the third buff is adhered on the inner surface in the groove, for polishing the rounded edges 1*d* and 1*e* of the chamfered portion 1 of the wafer W. The depth and the shape of the groove of the third buff are determined so that the third buff in the groove can mirror-polish about the rounded edges 1*d* and 1*e* formed between the peripheral side surface 1*a* and each of the beveled surfaces 1*b* and 1*c*, that is, so that the peak of contact pressure distribution between the third buff of the third polishing portion 11*c* and the chamfered portion 1 is on each of the rounded edges 1*d* and 1*e*.

The wafer holding device 12 comprises a suction disc 15 for holding the wafer W, which is communicated with a vacuum system (not shown), so that the wafer W can be held on the lower surface of the suction disc 15 by vacuum suction, a motor which is not shown, for rotating the suction disc 15 together with the wafer W through a shaft 16, a lifting device for lifting up and down the suction disc 15 with the wafer W to desired positions, and a pushing device which is not shown, for carrying the wafer W held on the suction disc 12 horizontally and pushing the wafer W against the polishing member 13. The main surface of the wafer W is approximately perpendicular to the rotation axis of the polishing device 11. Therefore, the suction disc 15 can rotate around the central axis thereof and can horizontally and vertically move relatively to the polishing device 11.

Next, an embodiment of the method for mirror-polishing using the above described apparatus for mirror-polishing will be explained.

As shown in FIG. 2, a wafer W is adhered to the lower surface of the suction disc 15 by vacuum suction and is rotated by the motor for the disc. The polishing member 13 is rotated on the rotary shaft 14 by the motor M. The height of the held wafer W is adjusted to correspond with that of the first polishing portion 11*a* of the polishing device 11 by the lifting device. The chamfered portion 1 of the wafer W is transferred to the first polishing portion 11*a* of the polishing device 11, as shown in FIG. 3, by using the pushing device. Then, the peripheral side surface 1*a* of the chamfered portion 1 of the wafer W comes into contact with and pushes against the first buff on the first polishing portion 11*a*, and mirror-polishing about the peripheral side surface 1*a* is carried out. Next, the wafer W is separated from the first polishing portion 11*a* by the pushing means and the height of the wafer W is adjusted to correspond with that of the second polishing portion 11*b* by the lifting device. The chamfered portion 1 of the wafer W is transferred to the second polishing portion by using the pushing device. The beveled surfaces 1*b* and 1*c* of the chamfered portion 1 of the wafer W come into contact with and push against the second buff on the inner surface of the second polishing portion 11*b* in the groove, and mirror-polishing about the beveled surfaces 1*b* and 1*c* is carried out. Then, the wafer W is separated from the second polishing portion by the pushing device and the height of the wafer W is adjusted to correspond with that of the third polishing portion 11*c*. The chamfered portion 1 of the wafer W is transferred to the third polishing portion 11*c* of the buff 11 by using the pushing device. The rounded edges 1*d* and 1*e* of the wafer W come into contact with and push against the third buff of the inner surface of the third polishing portion 11*c* in the groove, and mirror-polishing about the rounded edges 1*d* and 1*e* is carried out.

In the method and the apparatus 10 for mirror-polishing having such a construction, mirror-polishing of the peripheral side surface 1*a*, the beveled surfaces 1*b* and 1*c*, and the rounded edges 1*d* and 1*e*, of the peripheral chamfered portion 1 of the wafer W, are carried out by using individual polishing portions 11*a*, 11*b*, and 11*c* which are separated to one another. The first, second, and third polishing portions 11*a*, 11*b*, and 11*c* are concentrated in mirror-polishing of the peripheral side surface 1*a*, the beveled surfaces 1*b* and 1*c*, and the rounded edges 1*d* and 1*e*, of the peripheral chamfered portion 1, respectively. Accordingly, mirror-polishing for the every portions of the peripheral chamfered portion 1 of the wafer W can be performed securely and quickly with a small variations of the required processing time for polishing.

Although the present invention has been described in its preferred form with a certain degree of particularity, it should also be understood that the present invention is not limited to the preferred embodiment and that various changes and modifications may be made to the invention without departing from the spirit and scope thereof.

In the above-described embodiment, mirror-polishing of the peripheral chamfered portion 1 of the wafer W was carried out for the peripheral side surface 1*a*, the beveled surfaces 1*b* and 1*c*, and the rounded edges 1*d* and 1*e*, in that order. Although the present invention requires to individually carry out at least a part of mirror-polishings of the peripheral side surface 1*a*, the beveled surfaces 1*b* and 1*c*, and the rounded edges 1*d* and 1*e*, the order is not limited. The change of order also enables a secure and quick mirror-polishing of the peripheral chamfered portion with a small variations of the required processing time for polishing, similar to the above-described embodiment.

Figure 4:
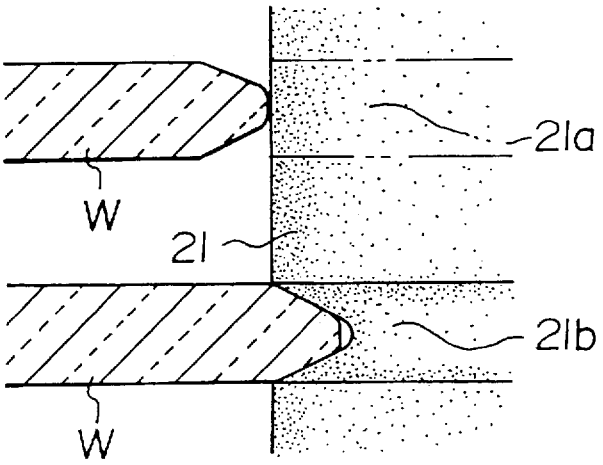
FIG. 4 is a view for explaining the method according to another embodiment of the present invention.

FIG. 4 shows another embodiment of the method for mirror-polishing of the present invention.

In this embodiment, the polishing device 21 comprises a first polishing portion 21*a* and a second polishing portion 21*b*, which are provided independent of the other. On the peripheral surfaces of the first and second polishing portions 21*a* and 21*b*, a first buff and a second buff are respectively adhered. The first polishing portion 21*a* is for mirror-polishing the peripheral side surface 1*a* of the chamfered portion 1 of the wafer W, and therefore, it has no grooves on the surface, similar to the first polishing portion 11*a* in the first embodiment. On the periphery of the second polishing portion 21*b*, a peripheral groove is formed and the second buff is adhered on the inner surface in the groove, for mirror-polishing the beveled surfaces 1*b* and 1*c* and the rounded edges 1*d* and 1*e* of the chamfered portion 1 of the wafer W. The depth and the shape of the groove of the second buff are determined so that the second buff in the groove can mirror-polish about each of the beveled surface 1*b* and 1*c* and the rounded edges 1*d* and 1*e*, that is, so that the peak of contact pressure distribution between the second buff of the second polishing portion 21*b* and the chamfered portion 1 is on each of the beveled surface 1*b* and 1*c* and the rounded edges 1*d* and 1*e*.

In the embodiment, first, mirror-polishing about the peripheral side surface 1*a* of the wafer W is carried out by using the first polishing portion 21*a*. Thereafter, mirror-polishing of the beveled surfaces 1*b* and 1*c* and the rounded edges 1*d* and 1*e* is carried out by using the second polishing portion 21*b*, in a manner similar to the first embodiment.

According to the embodiment, it is possible to securely and quickly mirror-polish the every portion of the peripheral chamfered portion 1 of the wafer W with a small variations of the required processing time for polishing, in comparison with the conventional method.

In order to see the effects, the following experiment was carried out.

Figure 5:
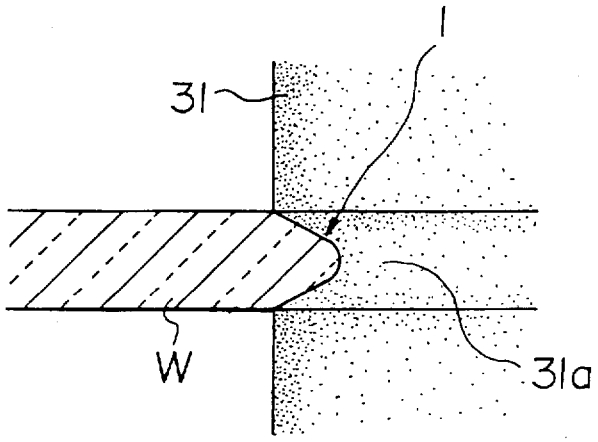
FIG. 5 (PRIOR ART)
FIG. 5 is a view for explaining a conventional method.

In the experiment, similar comparisons were made between the required time for obtaining a predetermined mirror-finished surface of the peripheral chamfered portion 1 of a wafer W by using the conventional polishing device 31 having only one polishing portion 31*a*, i.e., the so-called a form chamfering buff, as shown in FIG. 5, that of using the polishing device 21 having two polishing portions 21*a* and 21*b* according to the second embodiment of the present invention, as shown in FIG. 4, and that of use of the polishing device 11 according to the first embodiment, as shown in FIG. 3. As a result, the mirror-polishing by using the conventional polishing device 31 shown in FIG. 5 required about 12±9 min., and that of using the polishing device 21 of the second embodiment required about 5±2 min. On the other hand, according to use of the polishing device 11 of the first embodiment, in spite of having three steps, the entire surfaces of the peripheral chamfered portion 1 were mirror-polished for the total time of about 4±1 min.

What is claimed is:

1. A method for mirror-polishing a peripheral chamfered portion of a semiconductor wafer which comprises a peripheral side surface, beveled surfaces formed on front and back surfaces along the periphery of the wafer, and rounded edges formed between the peripheral side surface and each of the beveled surfaces, comprising:

rotating the wafer around a central axis thereof, and individually mirror-polishing the peripheral side surface, the beveled surfaces, and the rounded edges by a polishing device, wherein said mirror-polishing comprises simultaneously mirror-polishing the beveled surfaces formed on the front and back surfaces of the wafer and simultaneously mirror-polishing the rounded edges formed on the front and back surfaces of the wafer.

2. A method as claimed in claim 1, wherein the mirror-polishing of the peripheral side surface, the beveled surfaces, and the rounded edges of the peripheral chamfered portion, are performed by bringing the peripheral side surface, the beveled surfaces, and the rounded edges into contact with first, second, and third polishing portions, which are provided on the polishing device independent of one another, respectively, in an appropriate order.

3. A method as claimed in claim 2, wherein the first polishing portion comprises a first buff which can be in contact with the peripheral side surface of the peripheral chamfered portion, the second polishing portion comprises a second buff which can be in contact with the beveled surfaces, and the third polishing portion comprises a third buff which can be in contact with the rounded edges.

4. A method for mirror-polishing a peripheral chamfered portion of a semiconductor wafer which comprises a peripheral side surface, beveled surfaces formed on front and back surfaces along the periphery of the wafer, and rounded edges formed between the peripheral side surface and each of the beveled surfaces comprising;

rotating the wafer around the center thereof, and mirror-polishing the peripheral side surface, the beveled surfaces, and the rounded edges by a polishing device, wherein mirror-polishing of one of the peripheral side surface, the beveled surfaces, and the rounded edges is performed independent of mirror-polishing of an other of the peripheral side surface, the beveled surfaces, and the rounded edges; said mirror-polishing is simultaneously performed on the beveled surfaces formed on the front and back surfaces of the wafer and said mirror-polishing is simultaneously performed on the rounded edges formed on the front and back surfaces of the wafer.

5. An apparatus for mirror-polishing a peripheral chamfered portion of a semiconductor wafer which comprises a peripheral side surface, beveled surfaces formed on front and back surfaces along the periphery of the wafer, and rounded edges formed between the peripheral side surface and each of the beveled surfaces, comprising a cylindrical rotary polishing device which comprises;

a first polishing portion having a first buff having a substantially flat shape which is shaped so as to contact with and polish the peripheral side surface, a second polishing portion having a second buff which is shaped as a first groove so as to simultaneously contact with and polish both the beveled surfaces formed on the front back surfaces of the wafer, and a third polishing portion having a third buff which is shaped as a second groove so as to simultaneously contact with and polish both the rounded edges formed between the peripheral side surface and the beveled surfaces formed on the front and back surfaces of the wafer, wherein the first, second, and third buffs are formed in a body, the first, second, and third polishing portions are provided on the peripheral surface of the apparatus independent of one another, and said first, second and third buffs comprise different shaped cross sections relative to one another.

6. An apparatus claimed in claim 5; wherein the first buff of the first polishing portion can mirror-polish about the peripheral side surface of the peripheral chamfered portion of the wafer, the second buff of the second polishing portion can mirror-polish about each of the beveled surfaces, and the third buff of the third polishing portion can mirror-polish about each of the rounded edges.

7. An apparatus claimed in claim 5, further comprising a wafer holding device for holding the wafer, which can rotate around the central axis thereof and can horizontally and vertically move relatively to the polishing device.

8. An apparatus claimed in claim 7, wherein the wafer holding device comprises a suction disc for adhering a wafer thereto by vacuum suction.

* * * * *